United States Patent [19]

Cretin et al.

[11] 4,254,513

[45] Mar. 10, 1981

[54] DEODORANT-PRODUCT HOLDER FOR A LAVATORY PAN

[75] Inventors: Bertrand Crêtin, Tours; André M. Godefroy, Neuille-Pont-Pierre, both of France

[73] Assignee: Chiminter, Tours, France

[21] Appl. No.: 47,209

[22] Filed: Jun. 11, 1979

[30] Foreign Application Priority Data

Jun. 27, 1978 [FR] France ..... 78 19181

[51] Int. Cl.[3] ..... A47K 17/00; A61L 3/00; B01J 4/00; E03D 9/02

[52] U.S. Cl. ..... 4/231; 422/263; 422/266; 422/270; 422/276; 422/277; 422/292

[58] Field of Search ..... 422/263, 266, 277, 279, 422/275, 276, 292; 4/228, 229, 230, 231

[56] References Cited

U.S. PATENT DOCUMENTS

| | | | |
|---|---|---|---|
| D. 253,123 | 10/1979 | Jones | 4/231 X |
| 2,973,600 | 3/1961 | Reilly et al. | 422/263 |
| 4,203,172 | 5/1980 | Goncalves | 4/231 |

FOREIGN PATENT DOCUMENTS

| | | | |
|---|---|---|---|
| 2255161 | 8/1973 | Fed. Rep. of Germany | 4/231 |
| 2170341 | 9/1973 | France . | |
| 2258320 | 8/1975 | France | 4/231 |

*Primary Examiner*—Barry Richman

*Attorney, Agent, or Firm*—Brisebois & Kruger

[57] ABSTRACT

A holder for the receipt of a stick of lavatory pan deodorizing product comprises a perforated cage formed of two half-cages which have end collars which are a snap-fit together and within the connecting ring portions of a suspending hook, the snap-fit of the connecting ring portion to one of the half-cages only being possible after breaking of at least one tearable attachment which had been integrally moulded with the end collar of said one half-cage and the connecting ring portion, the end collars of the two half-cages carrying male and female fixing members for their direct snap-fit connection.

4 Claims, 5 Drawing Figures

2
13
12
5b 2
6
3
1
4
5c
7
5b
5a
13
III
15
17
14
2
13
16
7

8
6
4
11
3
9
10
III

DEODORANT-PRODUCT HOLDER FOR A LAVATORY PAN

DESCRIPTION

This invention relates to a holder for the receipt of a stick or block of a water-soluble product for the disinfection, cleansing and/or deodorisation of lavatory pans. Such holders are so placed inside a lavatory pan that the product carried therein can be wetted by the flushing water.

In a known embodiment, the perforated cage is associated with a separate suspending hook which the user must fix to the cage when it is positioned inside the pan. However, in order to avoid any risk that the perforated cage might become unhooked during use, in particular if the suspending hook has not been correctly positioned, it has also been proposed to manufacture ready-to-use holders of which the cage is rendered integral with the suspending hook, without the user having to carry out an assembling operation of any kind. Thus, French Pat. No. 2,170,341 has disclosed a holder consisting of two half-cages which snap onto a connecting ring integral with the suspending hook, this hook being arranged perpendicular to the axis of the cage.

An object of the present invention is to describe an improved holder, of the type indicated above, in which one of the half-cages originates from moulding with the suspending hook and is joined to the latter by a connecting ring which is initially joined to the half-cage by a tearable attachment. The holder according to the invention is assembled by breaking the tearable attachment and then snapping the connecting ring of the hook around the half-cage originating from moulding with the hook. The assembling of the second half-cage, which can only take place after breaking the tearable attachment and fixing the connecting ring around the first half-cage, is advantageously carried out by means of a simultaneous double snapping of the second half-cage onto the first and onto the connecting ring of the suspending hook. As a result, there is a strengthened mechanical joint between the three elements of the holder, compared with the holder, described in French Pat. No. 2,170,341, in which the two half-cages are snapped onto the connecting ring without being directly fixed to one another. Moreover, the user can cause the connecting ring to pivot about the cage in order to orientate the suspending hook as desired, relative to the cage. It can also be noted that the assembling of the holder is greatly simplified because it results from the joining together of two separate pieces instead of three as in the case of the holder of the above-mentioned French patent.

According to the present invention there is provided a holder for the receipt of a stick of product used for disinfecting and/or deodorising lavatory pans, the holder comprising a suspending hook having a connecting ring portion, and two half-cages each comprising at their open end an end collar, the end collars having male and female fixing members providing for the snap-fit connection together of the two half-cages, the connecting ring portion having been integrally moulded with one of the half-cages with a connecting tearable attachment and being a snap-fit about one of the end collars upon separation of the tearable attachment.

In a preferred embodiment, the connecting ring of the suspending hook is fixed by snapping-in around each of the two end collars of the half-cages; in its inner wall zone, which surrounds the end collar of the associated half-cage, the connecting ring of the hook comprises a peripheral snap-in ring which cooperates with an annular groove made on the outer wall of the said end collar; the cage is of substantially cylindrical shape, the assembling plane of the two half-cages being located in the transverse median plane of the cage; the suspending hook comprises a U-shaped part enabling it to be hooked onto the edge of a pan, one of the limbs of the U being articulated on the connecting ring by means of a moulded flexible hinge; the tearable attachment which joins the connecting ring of the hook to the end collar of the associated half-cage is presented in the form of a thin annular web, the connecting ring and the associated half-cage being coaxial and separated from one another, before breaking of the web, by a distance corresponding to the width of the above-mentioned web; the end collar of that half-cage which does not originate from moulding with the hook comprises two concentric skirts, the axis of which is essentially identical to that of the said half-cage, an outer skirt projecting radially relative to the perforated side wall of the half-cage, and an inner skirt projecting axially relative to the above-mentioned outer skirt; the outer and inner skirts both terminate in a peripheral snap-in ring extending perpendicular to the axis of the associated half-cage; the snap-in ring of the inner skirt cooperates with a groove, of suitable shape, housed inside the collar of that half-cage which originates from moulding with the hook, whilst the snap-in ring carried by the outer skirt cooperates with an annular groove, of complementary shape, which is housed on the inner wall of the connecting ring.

In order to provide a better understanding of the subject of the present invention, an embodiment thereof, which is shown in the accompanying drawings, will be described below by way of a purely illustrative and non-limiting example.

Figures 1, 2, 3:
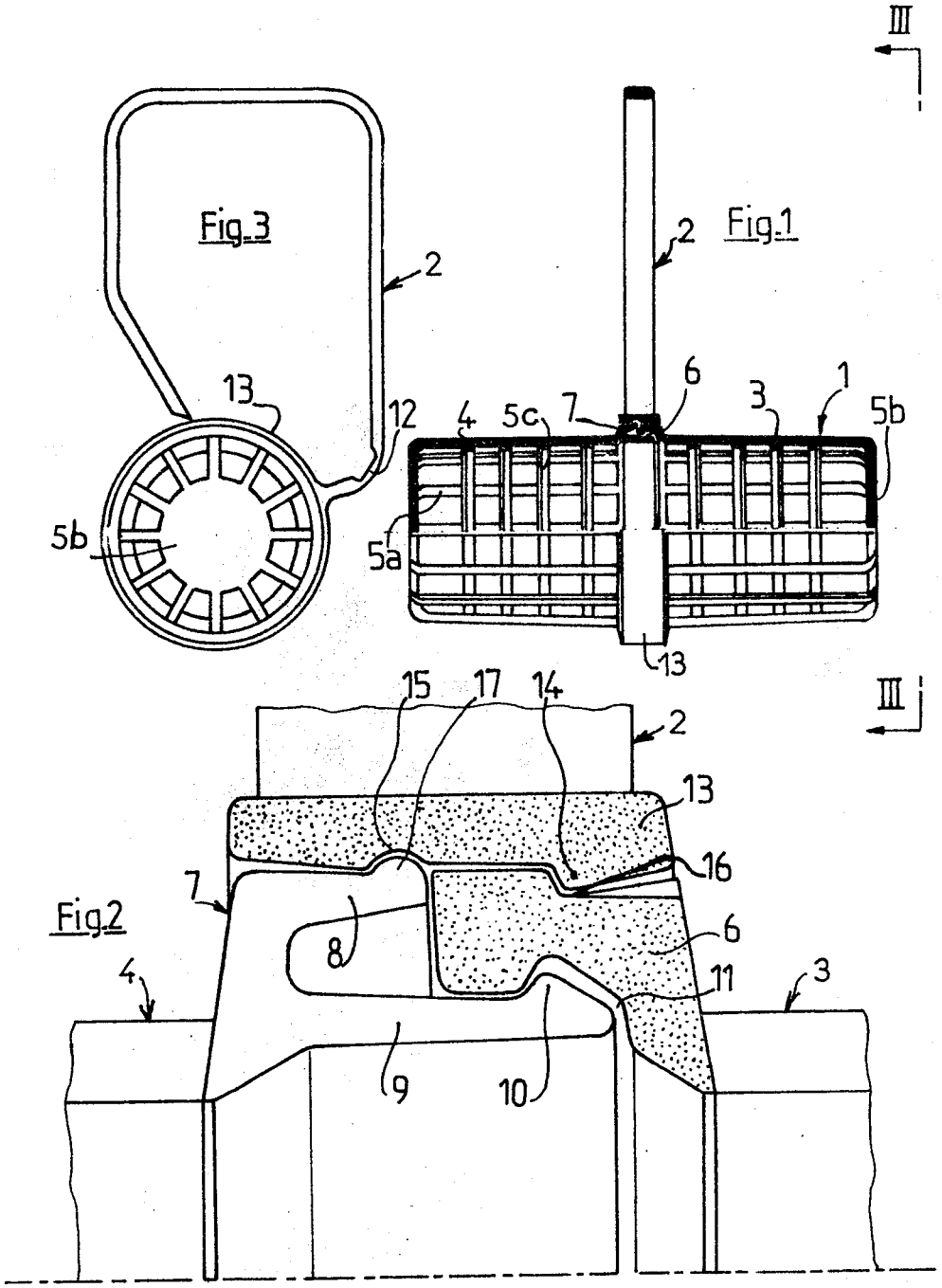
FIG. 1 shows, partially in elevation and partially in axial section, a holder according to the invention, after assembling, the stick of deodorant product which is intended to be contained in the cage not having been shown.
FIG. 2 shows, in axial section and on a larger scale, the method of joining together the two half-cages and the connecting ring of the suspending hook.
FIG. 3 shows a side view along III—III of FIG. 1.

With reference to the drawings, it is seen that they show a support consisting of a cage 1 intended to contain a stick of deodorant and disinfectant product, and a hook 2 for suspending the cage on the edge of a lavatory pan.

The cage 1, made of moulded plastics, is formed by assembling two half-cages 3 and 4. The cage 1, of substantially cylindrical shape, comprises bars 5*a* which are parallel to its axis and are connected, at each end of the cage, to a disc 5*b* and, in the zone of the transverse median plane of the cage, to an end peripheral collar 6 or 7 of the half-cages 3 and 4. The cage 1 is also provided with coaxial annular members 5c which are uniformly spaced along the cage and are arranged perpendicular to its axis. The two end collars 6 and 7 of the half-cages 3 and 4 form an annular rim which projects radially relative to the cylindrical perforated side wall of the half-cages. The end collar 7 of the half-cage 4 comprises two concentric skirts 8 and 9, coaxial with the cylindrical half-cage. The inner skirt 9 is arranged as an extension of the perforated side wall of the half-cage 4 and projects axially beyond the outer skirt 8.

In this embodiment, a male joining member, carried by the end collar 7 of the half-cage 4, cooperates with a corresponding female member housed on the end collar 6 of the half-cage 3 in order to ensure the fixing of the two half-cages by snapping-in. The male member is a peripheral ring 10 which projects radially outside the skirt 9 and which snaps into an annular groove 11, of complementary shape, provided on the inner wall of the end collar 6 of the half-cage 3. As can be seen in FIG. 2, the snap-in ring 10 cooperates with the groove 11, when the two half-cages 3 and 4 are assembled, whilst the outer skirt 8 of the end collar 7 rests against the end collar 6 of the half-cage 3, the outer walls of the skirt 8 and of the collar 6 being, in this position, located substantially in axial alignment.

The suspending hook 2 possesses a U-shaped part, that is to say two essentially parallel limbs connected by a bight. The longer limb of the U of the hook is connected by a flexible hinge 12, originating from moulding with the hook, to a substantially cylindrical connecting ring 13 which is fixed around the two half-cages when the holder is assembled. An annular snap-in ring 14, extending perpendicular to the axis of the connecting ring 13, is provided in relief on the inner wall of the connecting ring 13. A peripheral groove 15, parallel to the snap-in ring 14, is also provided inside the connecting ring 13. Thus, as can be seen in particular in FIG. 2, when the holder is assembled, the connecting ring 13 is arranged around the two end collars 6 and 7, to which it is fixed with a snap-fit; in this position, the snap-in ring 14 cooperates with a groove 16, of complementary shape, which is made on the outer wall of the end collar 6, whilst a peripheral ring 17, carried by the free end of the outer skirt 8, cooperates with the groove 15 in the connecting ring 13. Once the connecting ring 13 is fixed to the two end collars 6 and 7, the cooperation of the snap-in rings 17 and 14 in the corresponding grooves 15 and 16 prevents the connecting ring 13 from sliding relative to the perforated cage. On the other hand, if he wishes, the user can cause the connecting ring 13 to pivot about the two end collars of the two assembled half-cages in order to orientate the suspending hook relative to the said cage, for example during the operation in which the suspending hook is attached to the edge of a lavatory pan.

The suspending hook 2 originates from moulding with one of the half-cages, and the two half-cages can only be assembled after breaking a tearable attachment joining the suspending hook to the associated half-cage and then snap-fitting the connecting ring 13 around the end collar of the said half-cage.

Figure 4:
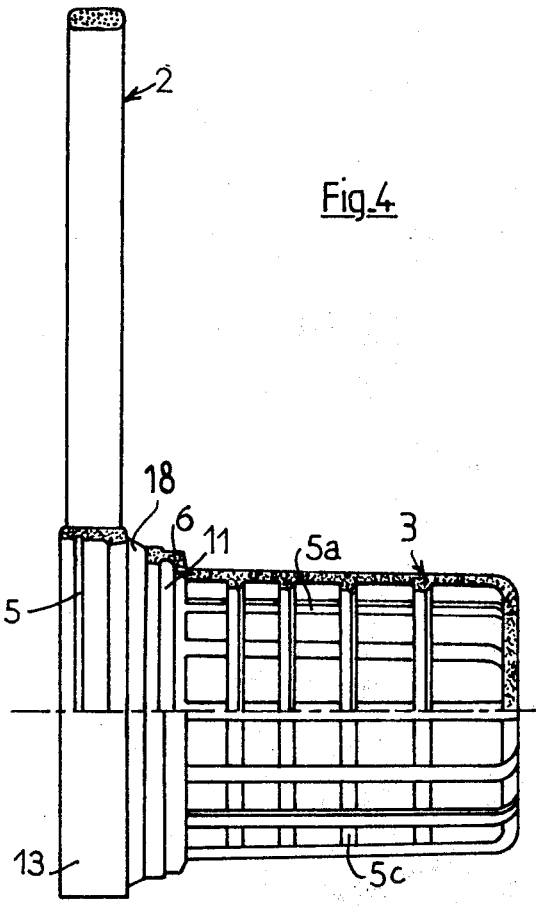
FIG. 4 shows, partially in elevation and partially in axial section, the suspending hook and one of the two half-cages joined by a tearable attachment.
Figure 5:
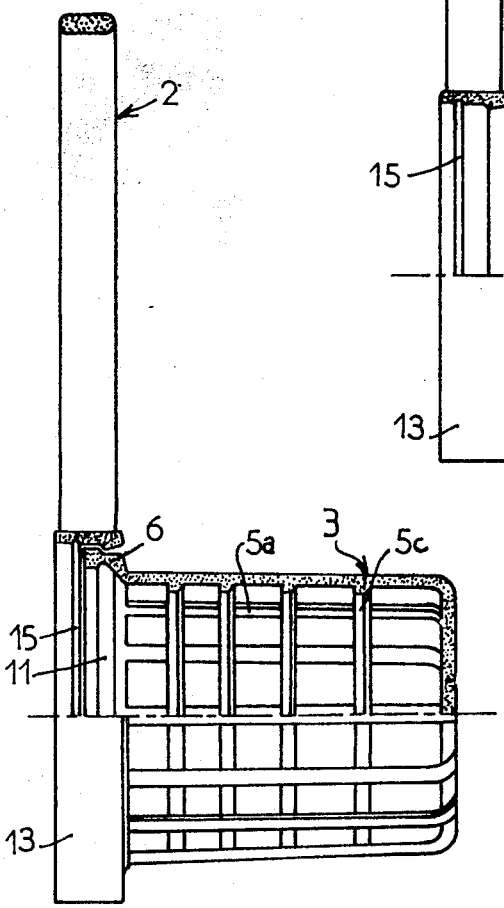
FIG. 5 shows, partially in elevation and partially in axial section, the half-cage and the suspending hook of FIG. 4, after breaking the tearable attachment and snapping the connecting ring of the hook onto the half-cage.

FIG. 4 of the drawing shows the half-cage 3 joined to the suspending hook 2 by a tearable attachment 18 integrally moulded with the hook 2 and the half-cage 3. The tearable attachment 18 is presented in the form of a peripheral thin web, which joins together the outer peripheral edge of the end collar 6 and the inner peripheral edge, adjacent to the snap-in ring 14, of the connecting ring 13. As can be seen in FIG. 4 of the drawing, before breaking the tearable attachment 18, the connecting ring 13 of the suspending hook and the half-cage 3 are essentially coaxial and separated from one another by a distance corresponding to the width of the web which constitutes the tearable attachment 18. The tearable attachment 18 can be broken in a simple manner by an operation in which the connecting ring 13 is pushed over the end collar 6, this operation simultaneously making it possible to fix the hook to the half-cage 3 by snapping the ring 14 inside the groove 16. FIG. 5 of the drawing shows the connecting ring 13 of the hook snapped onto the half-cage 3. A stick of water-soluble product can be introduced, if this has not already been done, inside the half-cage 3 to which the suspending hook is fixed; the unit shown in FIG. 5 can then be joined to the half-cage 4 by a simultaneous double fixing operation, namely the joining of the two half-cages to one another by snapping the ring 10 into the inner groove 11, and the joining of the half-cage 4 to the connecting ring 13 by snapping the ring 17 into the groove 15.

Compared with the deodorant-stick holder described in French Pat. No. 2,170,341, in which the two half-cages snap onto the connecting ring integral with the suspending hook, the holder according to the invention exhibits the advantage that:

it requires the assembling of only two independent pieces, instead of three pieces as in the above-mentioned French patent, because the suspending hook originates from moulding with one of the two half-cages;

it ensures a better joining of the unit because the two half-cages are not only snapped onto the connecting ring but are also directly fixed to one another by snap-in connection; and it permits the orientation of the suspending hook relative to its associated cage, by enabling the connecting ring to rotatably slide around the two assembled half-cages.

We claim:

1. A holder assembly for a solid deodorant product comprising, a first perforated cage section, a second perforated cage section; and means for connecting said cage sections together in end to end relation to provide a perforated cage for a solid deodorant product, said means comprising:

first and second connection members unitary with said cage sections, respectively, said first connection member including detent means for engagement with said second connection member, said second connection member comprising circumferentially extending skirts, one of said skirts including means for snap-fit engagement with said detent means, and a third connection member engaging said first and second connection members and including means extending thereabout for positively interconnecting said first connection member with said second connection member, and in which said first connection member detent means are disposed at radially inner and outer locations and said third connection member interconnecting means are disposed axially spaced from one another.

2. A holder as set forth in claim 1 further comprising a suspending hook, said suspending hook comprising a U-shaped part having a limb which is articulated to the third connection member by means of a flexible hinge.

3. The connection set forth in claim 1 in which said second connection member skirts are radially inner and outer skirts, and said interconnecting means comprise a groove and a projection.

4. The connection set forth in claim 3 in which at least two of said detent means are disposed in radially opposite directions so that one of said detent means engages said inner skirt and the other of said detent means engages said third connection member, and said second connection member inner skirt makes snap-fit engagement with said first connection member detent means, said second connection member outer skirt making snap-fitting engagement with said third connection member.

* * * * *